US012221972B2

(12) United States Patent
Fletcher

(10) Patent No.: US 12,221,972 B2
(45) Date of Patent: Feb. 11, 2025

(54) PUMP COMPRISING A BALANCE ARRANGEMENT AND A RELATED METHOD

(71) Applicant: FMC Technologies Do Brasil LTDA, Rio de Janeiro (BR)

(72) Inventor: Nicholas Fletcher, Vancouver (CA)

( * ) Notice: Subject to any disclaimer, the term of this patent is extended or adjusted under 35 U.S.C. 154(b) by 0 days.

(21) Appl. No.: 18/711,542

(22) PCT Filed: Nov. 18, 2021

(86) PCT No.: PCT/BR2021/050504
§ 371 (c)(1),
(2) Date: May 17, 2024

(87) PCT Pub. No.: WO2023/087085
PCT Pub. Date: May 25, 2023

(65) Prior Publication Data

US 2025/0003416 A1 Jan. 2, 2025

(51) Int. Cl.
*F04D 29/041* (2006.01)
*F04D 29/051* (2006.01)

(52) U.S. Cl.
CPC ..... *F04D 29/0416* (2013.01); *F04D 29/0516* (2013.01)

(58) Field of Classification Search
CPC ..... F04D 29/0416; F04D 29/0516
See application file for complete search history.

(56) References Cited

U.S. PATENT DOCUMENTS

| | | | | |
|---|---|---|---|---|
| 10,704,559 | B2 | 7/2020 | Funakoshi et al. | |
| 11,846,297 | B2 * | 12/2023 | De Raeve | F04D 13/086 |
| 2017/0175752 | A1 | 6/2017 | Hofer et al. | |
| 2017/0183942 | A1 | 6/2017 | Veland | |
| 2020/0248538 | A1 | 8/2020 | Xiao et al. | |
| 2020/0340480 | A1 * | 10/2020 | Felix | F04D 13/08 |
| 2021/0324862 | A1 * | 10/2021 | Widmer | F04D 29/106 |

FOREIGN PATENT DOCUMENTS

| | | | |
|---|---|---|---|
| CN | 105736399 | A | 7/2016 |
| CN | 111120414 | A | 5/2020 |
| EP | 3 486 493 | A1 | 5/2019 |

* cited by examiner

*Primary Examiner* — Courtney D Heinle
*Assistant Examiner* — Danielle M. Christensen

(57) ABSTRACT

A pump (110) is disclosed comprising: an inlet (114) being in fluid communication with an inlet cavity (115); an outlet (118) being in fluid communication with an outlet cavity (119); a motor (120) being arranged in a motor cavity (121); a pump axis (122) being rotatably drivable by the motor: impellers (124) being positioned between the inlet cavity and the outlet cavity and being actuatable by the pump axis to cause a differential pressure across the inlet cavity and the outlet cavity; and a balance arrangement (126) configured to at least partially offset an axial thrust affected upon the axis by the impellers when the pump is in operation, the balance arrangement comprising: a balance cavity (132); a balance drum (128) arranged between the outlet cavity and the balance cavity; and a balance line (134) extending between and fluidly connecting the balance cavity and the inlet cavity. The inlet is in fluid communication with the inlet cavity via the balance cavity and the balance line. A related method is also disclosed.

6 Claims, 2 Drawing Sheets

PUMP COMPRISING A BALANCE ARRANGEMENT AND A RELATED METHOD

FIELD OF THE INVENTION

The present invention relates to a pump comprising a balance arrangement. In particular, the present invention relates to a subsea rotordynamic pump or compressor comprising a balance arrangement and being configured for pumping fluids in a hydrocarbon production and processing system. The present invention also relates to a method of operating such a pump.

In this disclosure, the term "pump" is understood to also comprise a compressor. Consequently, whenever "pump" is stated in the following disclosure and claims, "pump/compressor" is to be understood.

BACKGROUND

In a rotordynamic pump, each impeller tends to produce some amount of axial thrust because of different pressures and different geometries on the two sides of the impeller. Therefore, in a high pressure multi-stage pump or compressor, the net thrust would be large unless action is taken to balance it out. The two main ways to reduce the net thrust are to oppose the impellers or to use a balance drum or disc. The present invention relates to the latter.

Pumps comprising balance arrangements are known in the art. For example, US2017183942A1 discloses a subsea pump comprising a balance piston offsetting axial thrust enforced upon the pump axis by the pump impellers. Subsea pumps comprising balance arrangements are also disclosed in US2020248538A1, CN111120414A, CN105736399A, EP3486493A1 and US2017175752A1.

A schematic illustration of a prior art rotordynamic pump is shown in FIG. 1. The pump 10 has a suction side 12 comprising an inlet 14 being in fluid communication with an inlet cavity 15. The pump 10 also comprises a discharge side 16 comprising an outlet 18 being in fluid communication with an outlet cavity 19. The pump 10 further comprises an electric motor 20 arranged in a motor cavity 21 and an axis 22 rotatably driven by the motor 20. The pump 10 also comprises impellers 24 mounted on the axis 22.

The pump 10 further includes a balance arrangement 26 comprising a balance drum 28 rotatably arranged in a non-rotating balance liner 30. The liner 30 is positioned after the last impeller stage so as to have full discharge pressure acting on one side. On the other side of the balance drum 28 is a balance cavity 32. A balance line 34 extends between the balance cavity 32 and the inlet cavity 15.

When the pump is in operation, there is a small clearance gap between the rotating balance drum 28 and the non-rotating balance liner 30 allowing a small amount of fluid on the discharge side 16 to flow to the balance cavity 32. This flow, known as the balance flow, is subjected to throttling on its way through the gap, resulting in a pressure differential across the balance drum, i.e. between the discharge side 16 and the balance cavity 32. This pressure differential results in an axial force acting upon the balance drum 28 which counteracts the impellers' 24 axial thrust, thus reducing or, preferably, cancelling out the load on the thrust bearings of the pump.

The balance flow is routed back to the inlet cavity 15 via the balance line 34. Thus, the balance drum 28 in effect acts as a piston with discharge pressure acting on one side and suction pressure acting on the other.

At the extreme of the balance cavity 32 away from the balance drum 28 is a rotary seal 36 through which the axis 22 runs. The seal 36 prevents fluids from leaking into the internals of the motor 20. Since the kind of rotary seal 36 used is not totally leakfree, the internals of the motor 20 and the motor cavity 21 are filled with a fluid, called the barrier fluid, which is maintained at a slightly higher pressure than the suction pressure.

The balance cavity 32 is thus filled with the pumped process fluid which has leaked past the balance drum 28, i.e. the balance fluid, plus some barrier fluid which has leaked past the seal 36.

As the process fluid leaks past the balance drum 28 it suffers a rapid depressurisation and also an increase in temperature due to the violent shearing in the annular gap between the balance drum 28 and the balance liner 30. This fluid then mixes with an amount of barrier fluid in the balance cavity 32. These balance cavity conditions can sometimes, in particular in subsea hydrocarbon production and processing systems, lead to precipitation of solids from the fluid. In turn, deposits (generally known as scale) may accumulate on the surfaces in the balance cavity area. The accumulation of such deposits may, in turn, adversely affect the operation of the pump. Also, the high temperature due to the shearing in the annular gap may compromise the seal function, even without the issue of scale formation.

A known method to avoid this accumulation problem includes adding special chemicals to the process fluid or the barrier fluid, either upstream the balance cavity 32 or into the balance cavity itself. However, this is an arduous process which needs to be repeated continuously.

The present invention seeks to provide an alternative way to solve or at least reduce the aforementioned problem.

SUMMARY OF THE INVENTION

With the abovementioned challenges and known solutions in mind, and according to a first example aspect, the present invention provides a pump comprising:

- an inlet being in fluid communication with an inlet cavity;
- an outlet being in fluid communication with an outlet cavity;
- a motor being arranged in a motor cavity;
- a pump axis being rotatably drivable by the motor;
- impellers being positioned between the inlet cavity and the outlet cavity and being actuatable by the pump axis to cause a differential pressure across the inlet cavity and the outlet cavity; and a balance arrangement configured to at least partially offset an axial thrust effected upon the axis by the impellers when the pump is in operation, the balance arrangement comprising:
- a balance cavity;
- a balance drum arranged between the outlet cavity and the balance cavity; and
- a balance line extending between and fluidly connecting the balance cavity and the inlet cavity, wherein the inlet is in fluid communication with the inlet cavity via the balance cavity and the balance line.

In other words, the inlet fluid of the pump is routed to the inlet cavity via the balance cavity and the balance line. This will reduce the temperature and the accumulation of deposits (e.g. scaling) in the balance cavity, which will increase the reliability of the pump.

Consequently, as compared to conventional pumps, the balance cavity and the balance line must be dimensioned to be able to handle the through-put of the inlet fluid.

The motor cavity may be separated from the balance cavity by a rotary seal through which the axis runs. The rotary seal may be configured to allow leakage of a barrier fluid from the motor side of the seal to the balance cavity. This will provide the additional advantage that the operating temperature at the rotary seal will be reduced, allowing alternative seal designs to be used, which may increase the reliability of the seal and, thus, the overall reliability of the pump.

The balance arrangement may be configured to allow leakage of a balance fluid from the outlet cavity to the balance cavity.

The pump may be a subsea pump for pumping fluids in a hydrocarbon production and processing system, in which case the input flow regime according to the invention is particularly advantageous since scale build-up is an ever-present problem in such system. Also, in subsea pumps reliability is an issue as they are less available for maintenance than surface pumps.

The inlet cavity is arranged upstream of the first impeller or impeller stage and the outlet cavity is arranged downstream of the last impeller or impeller stage. The pump may be a single stage or a multi-stage pump.

According to a second example aspect, the present invention provides a method of pumping an inlet fluid using a pump comprising;

an inlet being in fluid communication with an inlet cavity;

an outlet being in fluid communication with an outlet cavity;

a motor being arranged in a motor cavity;

a pump axis rotatably driven by the motor;

impellers being positioned between the inlet cavity and the outlet cavity and being actuatable by the pump axis to cause a differential pressure across the inlet cavity and the outlet cavity; and a balance arrangement configured to at least partially offset an axial thrust effected upon the axis by the impellers when the pump is in operation, the balance arrangement comprising:

a balance cavity a balance drum arranged between the outlet cavity and the balance cavity; and a balance line extending between and fluidly connecting the balance cavity and the inlet cavity, wherein the method comprises directing the inlet fluid to the inlet cavity via the balance cavity and the balance line.

The method may comprise leaking a balance fluid through the balance arrangement from the outlet cavity to the balance cavity, and leaking a barrier fluid through the rotary seal from the motor cavity to the balance cavity, thus allowing the inlet fluid, the balance fluid and the barrier fluid to be mixed in the balance cavity prior to being directed to the inlet cavity via the balance line.

The above-discussed preferred and/or optional features of each aspect of the invention may be used, alone or in appropriate combination, in the other aspects of the invention.

DESCRIPTION OF THE DRAWINGS

The following drawings are appended to facilitate the understanding of the invention.

In the drawings, like reference numerals have been used to indicate common parts, elements or features unless otherwise explicitly stated or implicitly understood by the context.

DETAILED DESCRIPTION OF THE INVENTION

In the following, a specific embodiment of the invention will be described in more detail with reference to FIG. 2. However, it is specifically intended that the invention is not limited to the embodiments and illustrations contained herein but includes modified forms of the embodiments including portions of the embodiments and combinations of elements of different embodiments as come within the scope of the following claims. It should be appreciated that in the development of any such actual implementation, as in any engineering or design project, numerous implementation-specific decisions must be made to achieve the developer's specific goals, such as compliance with system and/or business related constraints, which may vary from one implementation of the invention to another. Moreover, it should be appreciated that such a development effort might be complex and time consuming, but would nevertheless be a routine undertaking of design, fabrication and manufacture for the skilled person having the benefit of this disclosure.

According to the present invention, accumulation of deposits on the surfaces in the balance cavity area is at least reduced by increasing the flow through the balance cavity. This will have a mechanical flushing effect and also cause the dilution of leaked barrier fluid.

Figure 1:
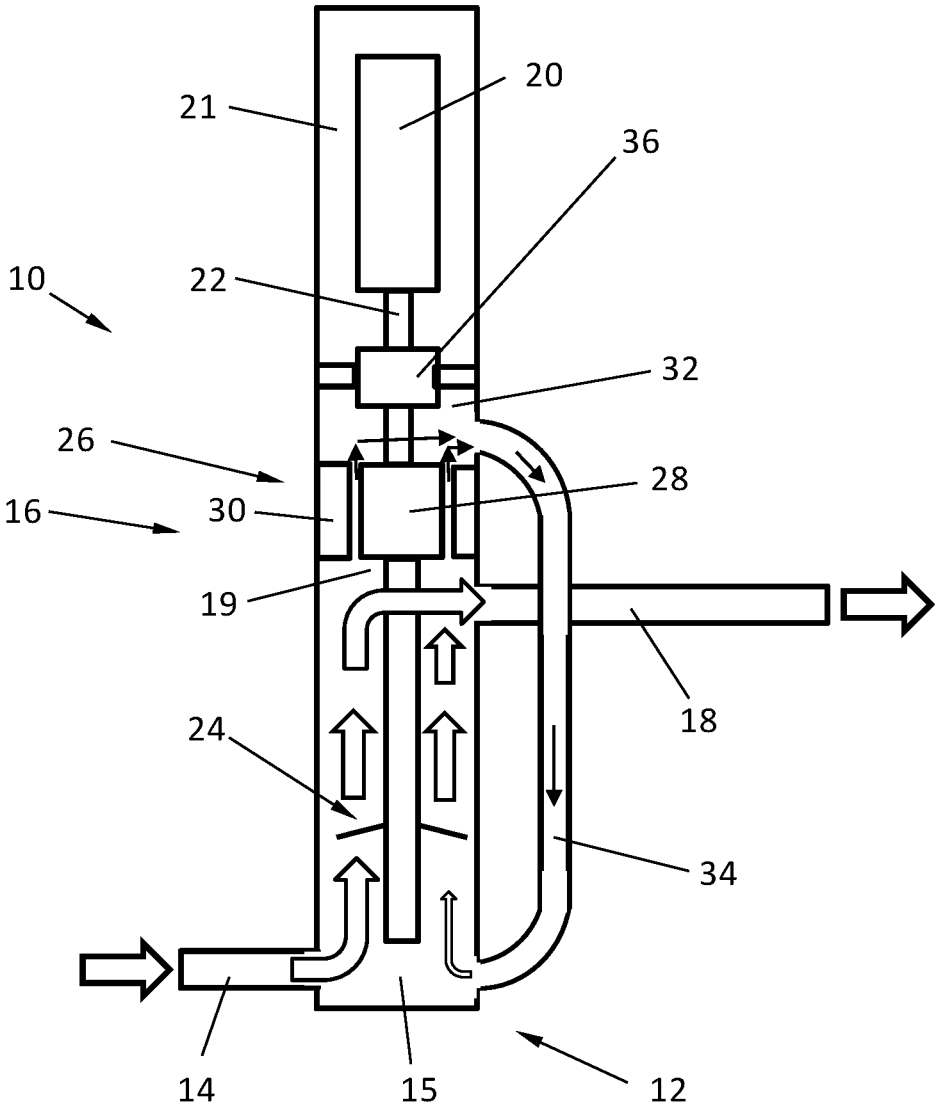
Fig. 1 (Prior Art)
FIG. 1 schematically illustrates a prior art pump.
Figure 2:
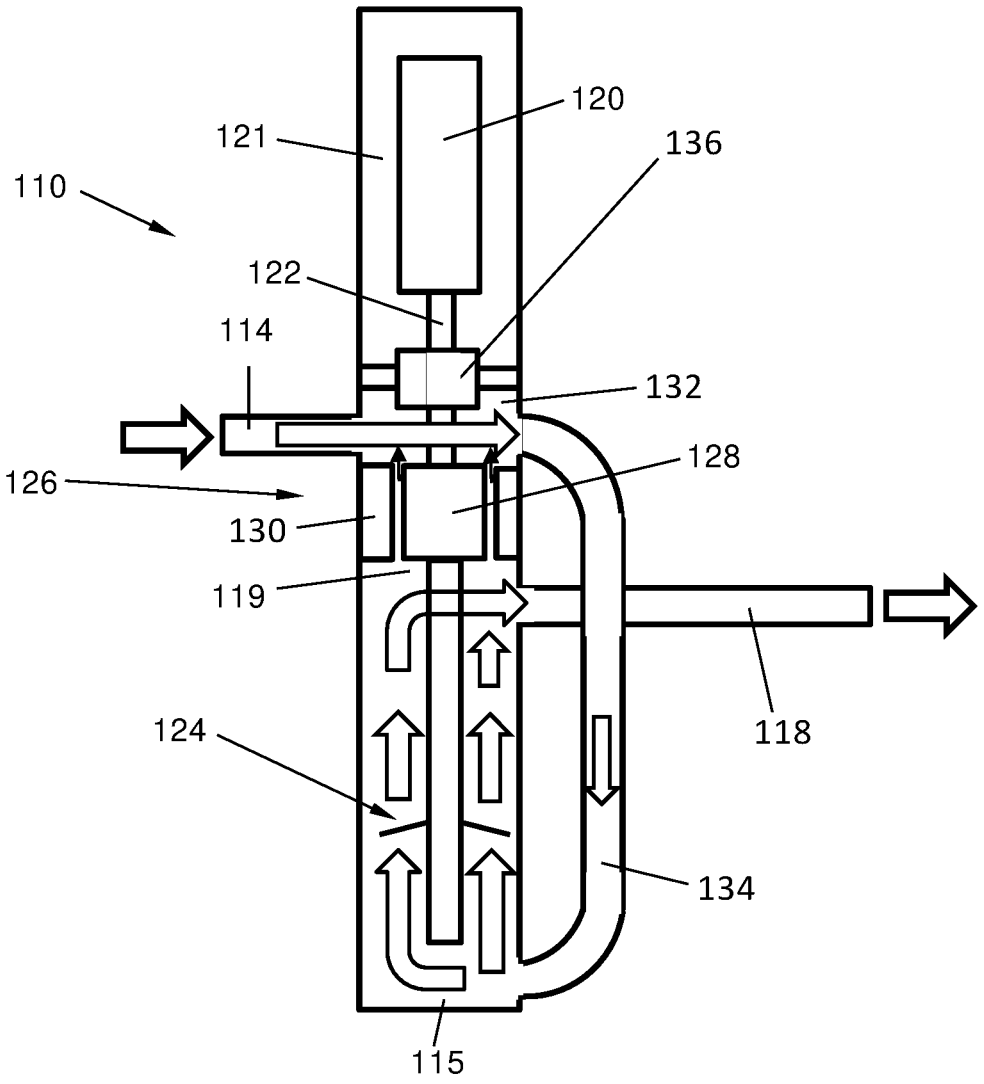
FIG. 2 schematically illustrates an embodiment of a pump according to the present invention.

An embodiment of a pump 110 according to the present invention is schematically illustrated in FIG. 2.

The pump 110 comprises an inlet 114 which is in fluid communication with an inlet cavity 115 and an outlet 118 which is in fluid communication with an outlet cavity 119. The pump 110 further comprises a motor 120 which is arranged in a motor cavity 121, and a pump axis 122 which is rotatably drivable by the motor 120.

The pump 110 also comprises impellers 124 which are positioned between the inlet cavity 115 and the outlet cavity 119 and which are actuatable by the pump axis 122 to cause a differential pressure across the inlet cavity 115 and the outlet cavity 119, i.e. across the inlet 114 and the outlet 118.

The pump 110 further comprises a balance arrangement 126 configured to at least partially offset an axial thrust effected upon the axis 122 by the impellers 124 when the pump 110 is in operation. The balance arrangement 126 comprises a balance cavity 132, a balance drum 128 arranged between the outlet cavity 119 and the balance cavity 132, and a balance line 134 extending between and fluidly connecting the balance cavity 132 and the inlet cavity 115.

The inlet 114 is in fluid communication with the inlet cavity 115 via the balance cavity 132 and the balance line 134 allowing the inlet fluid to be routed to the inlet cavity via the balance cavity and the balance line. In other words, the entire inlet flow of the pump 110 is routed through the balance cavity 132 on its ways to the inlet cavity 115.

As previously stated, this will reduce temperature and accumulation of deposits (e.g. scaling) in the balance cavity 132, which will increase the reliability of the pump.

The motor cavity 121 may be separated from the balance cavity 132 by a rotary seal 136 through which the axis 122 runs, which rotary seal 136 may be configured to allow leakage of a barrier fluid from the motor side of the seal 136, i.e. from the motor cavity 121, to the balance cavity 132.

Since the inlet flow is routed through the balance cavity 132 on its way to the inlet cavity 115, the inlet flow will reduce the operating temperature at the mechanical seal 136, thus allowing alternative mechanical seal designs to be used, which also may increase seal reliability.

The balance arrangement 126 allows leakage of a portion of the pumped fluid from the outlet cavity 119 to the balance cavity 132, allowing the leaked fluid to act as a balance fluid.

In operation of the pump 110, the inlet fluid is directed to the inlet cavity 115 via the balance cavity 132 and the balance line 134.

The balance fluid being leaked through the balance arrangement 126 from the outlet cavity 119 to the balance cavity 132, and the barrier fluid being leaked through the rotary seal 136 from the motor cavity 121 to the balance cavity 132 will mix in the balance cavity 132 prior to being directed to the inlet cavity 115 via the balance line 134. As a consequence, the inlet fluid will cool the balance cavity 132 and also dilute the balance and barrier fluids, thus cooling the balance cavity 132 and its surroundings (including the seal 136) and prevent build-up of deposits, e.g. scale.

In the preceding description, various aspects of the apparatus according to the invention have been described with reference to the illustrative embodiment. For purposes of explanation, specific numbers, systems and configurations were set forth in order to provide a thorough understanding of the apparatus and its workings. However, this description is not intended to be construed in a limiting sense. Various modifications and variations of the illustrative embodiment, as well as other embodiments of the apparatus, which are apparent to person skilled in the art to which the disclosed subject-matter pertains, are possible within the scope of the present invention as defined by the following claims.

The invention claimed is:

1. A pump comprising:
an inlet in fluid communication with an inlet cavity;
an outlet in fluid communication with an outlet cavity;
a motor arranged in a motor cavity;
a pump axis rotatably drivable by the motor;
a number of impellers positioned between the inlet cavity and the outlet cavity and being actuatable by the pump axis to cause a differential pressure across the inlet cavity and the outlet cavity; and
a balance arrangement configured to at least partially offset an axial thrust effected upon the axis by the impellers when the pump is in operation, the balance arrangement comprising:
a balance cavity;
a balance drum arranged between the outlet cavity and the balance cavity; and
a balance line extending between and fluidly connecting the balance cavity and the inlet cavity;
wherein the inlet is in fluid communication with the inlet cavity via the balance cavity and the balance line.

2. The pump according to claim 1, wherein the motor cavity is separated from the balance cavity by a rotary seal through which the axis runs.

3. The pump according to claim 2, wherein the rotary seal is configured to allow leakage of a barrier fluid from the motor cavity to the balance cavity.

4. The pump according to claim 1, wherein the balance arrangement is configured to allow leakage of a balance fluid from the outlet cavity to the balance cavity.

5. A method of pumping an inlet fluid using a subsea pump, the subsea pump comprising:
an inlet in fluid communication with an inlet cavity;
an outlet in fluid communication with an outlet cavity;
a motor arranged in a motor cavity;
a pump axis rotatably driven by the motor;
a number of impellers positioned between the inlet cavity and the outlet cavity and being actuatable by the pump axis to cause a differential pressure across the inlet cavity and the outlet cavity; and
a balance arrangement configured to at least partially offset an axial thrust effected upon the axis by the impellers when the pump is in operation, the balance arrangement comprising:
a balance cavity;
a balance drum arranged between the outlet cavity and the balance cavity; and
a balance line extending between and fluidly connecting the balance cavity and the inlet cavity;
wherein the method comprises directing the inlet fluid to the inlet cavity via the balance cavity and the balance line.

6. The method according to claim 5, further comprising:
separating the motor cavity from the balance cavity using a rotary seal through which the axis extends;
leaking a balance fluid through the balance arrangement from the outlet cavity to the balance cavity; and
leaking a barrier fluid through the rotary seal from the motor cavity to the balance cavity;
wherein the inlet fluid, the balance fluid and the barrier fluid are mixed in the balance cavity prior to being directed to the inlet cavity via the balance line.

* * * * *